US011697980B2

(12) United States Patent
Goyeneche

(10) Patent No.: US 11,697,980 B2
(45) Date of Patent: Jul. 11, 2023

(54) APPARATUS AND METHOD FOR ELECTROMECHANICALLY CONNECTING A PLURALITY OF GUNS FOR WELL PERFORATION

(71) Applicant: Sergio F Goyeneche, Spring, TX (US)

(72) Inventor: Sergio F Goyeneche, Spring, TX (US)

( * ) Notice: Subject to any disclaimer, the term of this patent is extended or adjusted under 35 U.S.C. 154(b) by 0 days.

(21) Appl. No.: 16/832,076

(22) Filed: Mar. 27, 2020

(65) Prior Publication Data

US 2020/0248535 A1 Aug. 6, 2020

Related U.S. Application Data

(63) Continuation-in-part of application No. PCT/US2019/019568, filed on Feb. 26, 2019.

(60) Provisional application No. 62/883,126, filed on Aug. 6, 2019.

(51) Int. Cl.

| | |
|---|---|
| ***E21B 17/02*** | (2006.01) |
| ***E21B 17/042*** | (2006.01) |
| ***E21B 43/117*** | (2006.01) |
| ***E21B 43/1185*** | (2006.01) |
| ***E21B 43/119*** | (2006.01) |
| ***F42D 1/055*** | (2006.01) |

(52) U.S. Cl.

CPC ..... *E21B 43/119* (2013.01); *E21B 17/028* (2013.01); *E21B 17/042* (2013.01); *E21B 43/117* (2013.01); *E21B 43/1185* (2013.01); *F42D 1/055* (2013.01)

(58) Field of Classification Search

CPC .. E21B 43/119; E21B 17/042; E21B 43/1185; E21B 43/117; E21B 17/028; F42D 1/055; F42D 3/04; F42B 3/02

See application file for complete search history.

(56) References Cited

U.S. PATENT DOCUMENTS

| | | | | |
|---|---|---|---|---|
| 6,851,471 | B2 * | 2/2005 | Barlow | E21B 17/042 102/307 |
| 7,565,927 | B2 * | 7/2009 | Gerez | E21B 43/116 166/250.01 |
| 7,762,331 | B2 * | 7/2010 | Goodman | E21B 43/117 166/299 |

(Continued)

FOREIGN PATENT DOCUMENTS

| | | | | |
|---|---|---|---|---|
| WO | WO-2015179787 | A1 * | 11/2015 | E21B 43/117 |
| WO | WO-2020176075 | A1 * | 9/2020 | E21B 43/119 |
| WO | WO-2021035143 | A1 * | 2/2021 | F42D 1/045 |

OTHER PUBLICATIONS

Baumann et al., Perforating Innovations—Shooting Holes in Performance Models, 2014, Oilfield Review, Autumn 2014: 26, No. 3, p. 14-31 (Year: 2014).*

*Primary Examiner* — Daniel P Stephenson

(74) *Attorney, Agent, or Firm* — The Law Offices of Kevin M. Jones & Associates, LLC

(57) ABSTRACT

A perforation gun having a modified pin end for positioning a blast shield between adjacent guns, the blast shield electrically joining movable contact pins and propagating firing signals between while protecting against blast forces from previous explosions. The perforation guns also having a wiring port in the charge carrier and alignment pin for opening and adding detonation circuitry at time of use, positioned within the charge carrier where it is protected from damages caused by rough handling, flooding, vibrations, and blast forces.

19 Claims, 10 Drawing Sheets

(56) References Cited

U.S. PATENT DOCUMENTS

| | | | | |
|---|---|---|---|---|
| 8,091,477 | B2 * | 1/2012 | Brooks | F42B 3/121 102/202.7 |
| 8,943,943 | B2 * | 2/2015 | Tassaroli | E21B 43/119 89/1.15 |
| 9,115,572 | B1 * | 8/2015 | Hardesty | E21B 43/119 |
| 9,194,219 | B1 * | 11/2015 | Hardesty | E21B 43/119 |
| 9,494,021 | B2 * | 11/2016 | Parks | E21B 43/117 |
| 9,689,223 | B2 * | 6/2017 | Schacherer | E21B 43/117 |
| 10,161,733 | B2 * | 12/2018 | Eitschberger | H05K 5/0065 |
| 10,174,595 | B2 * | 1/2019 | Knight | E21B 43/117 |
| 10,273,788 | B2 * | 4/2019 | Bradley | F42B 5/035 |
| 10,352,136 | B2 * | 7/2019 | Goyeneche | E21B 43/117 |
| 2013/0037255 | A1 * | 2/2013 | Kash | E21B 43/119 166/55 |
| 2015/0000509 | A1 * | 1/2015 | Current | E21B 43/116 89/1.15 |
| 2015/0337635 | A1 * | 11/2015 | Langford | E21B 43/116 89/1.15 |
| 2018/0347325 | A1 * | 12/2018 | Goyeneche | E21B 43/11855 |
| 2020/0248535 | A1 * | 8/2020 | Goyeneche | E21B 17/042 |

* cited by examiner

APPARATUS AND METHOD FOR ELECTROMECHANICALLY CONNECTING A PLURALITY OF GUNS FOR WELL PERFORATION

CROSS-REFERENCE TO RELATED APPLICATIONS

This application claims priority under 35 U.S.C. § 119(e) and 37 C.F.R. § 1.78(a) to U.S. Provisional Application No. 62/883,126 filed by Sergio F. Goyeneche, titled "Apparatus and Method for Electromechanically Connecting a Plurality of Guns for Well Perforation" on 6 Aug. 2019 which, by this statement is incorporated herein by reference for all purposes.

This application claims priority under 35 U.S.C. § 120 and 37 C.F.R. § 1.78(d) to International Patent Application No. PCT/US19/019568 filed in the U.S. Receiving Office by Sergio F. Goyeneche, titled "Apparatus for Assembly of Perforation Guns with Electrical Signal Propagation and Flooding Protection during Well Drilling Operations" on 26 Feb. 2019 which, by this statement is incorporated herein by reference for all purposes.

STATEMENT REGARDING FEDERALLY SPONSORED RESEARCH OR DEVELOPMENT

Not Applicable.

BACKGROUND OF THE INVENTION

Field of the Invention

This invention refers in general to an integral assembly (a "perf assembly") of a plurality of perforating guns ("guns") containing a plurality of shape charges ("charges") for the perforation of wellbores. This invention is particularly directed to a new electro-mechanical assembly for connecting a series of guns to allow reliable physical and electrical connections, and reliable firing of the guns sequentially during the perforation process of production wells.

Background of the Invention

The perforation of wells is accomplished by lowering into the wellbore a perf assembly comprised of a plurality of perforating guns each containing a plurality of shape charges oriented facing outward around the central axis. The guns are connected end to end and wired in sequence to a firing circuit which is in communication with a fire control module at the surface. The plurality of guns is coupled together physically and electrically to allow passing of electrical firing signals from the surface through all guns, while also isolating damaging explosive forces from adjacent guns fired earlier in the sequence.

In earlier applications intermediate subs of substantial size and weight were used to join a plurality of guns together. These subs had end to end pass-through openings and side access compartments for access to interior wiring comprised of detonation circuitry. These subs were often destroyed or damaged beyond reuse during firing sequences. Other embodiments attempted to reduce waste by developing smaller, less substantial subs where wiring was connected prior to joining the subs. These smaller subs were still likely to be damaged, but there was less wasted materials and financial losses.

The method of joining a plurality of guns with intermediate subs with multiple connections means wires are often twisted, broken, or can be pulled loose during the assembly process by the act of screwing on subs and joining the components together. In short, more connections equal more potential problems. This results in assemblies requiring deconstruction and repairs, or worse, weakened wires passing surface testing during construction but failing during the process of lowering to depth, or as a result of vibrations from earlier explosions in the firing sequence.

The preferred method is to fire the farthest/lowest gun first. Then, sequentially fire each gun back toward the well opening. This is because the explosion/pressure/debris from one gun's explosions can possibly damage the adjoining guns. Wires break or connectors loosen during shockwave vibrations or by blast force. Guns that fail to fire are highly undesirable since they are hazardous to bring to the surface due to the dangers of handling explosives which are not known to be in a safe condition or state.

To fulfill the operation briefly described above, while simultaneously respecting existing norms for the manipulation of explosives, highly capable operators must arm and assemble the guns at the wellhead, stripping the ends of insulated connecting wires and joining them in prescribed configurations, then re-insulating and protecting from sharp edges, crimping, etc. the exposed wires resulting in an 'artisanal' activity requiring skill and extreme caution.

It should be noted that petroleum production and exploration activities are generally located in areas with hostile climatic conditions for the operators, work hours are assigned in accordance to the needs of the operation and may include nighttime and daytime hours, with extreme cold or heat and rain or wind. Hours are controlled by working against the clock and by penalizing deadlines and other pressures.

To that respect, it is necessary that the strictest safety norms be followed while handling explosive material; all of these factors taken together contribute to an increased likelihood that operators may commit errors while wiring or assembling the guns into a perf assembly to be introduced into the well. Further, even if the operators do everything correctly, the actions required to connect the pipe sections that make up the perf assembly may still produce a costly mistake.

From the above facts, there exists an obvious need to simplify the operation of arming and joining the guns into a perf assembly. There is also a need to ensure that the firing of one gun does not introduce faults into the remaining portions of the perf assembly preventing the required firing sequence. The object of this innovation is to provide an electro mechanical connection of the gun assembly which may be reliably assembled on-site in unfavorable conditions, allows electrical signal propagation across the joints, and provides water resistance and resistance to blast forces between guns and from the external casing environment.

While this innovation is generally found in the petroleum industry, it may be equally applied to other environments of drilling production where perforation of well casing, etc. into the surrounding environment is necessary, such as water wells.

SHORT DESCRIPTION OF THE DRAWINGS

SUMMARY OF THE INVENTION

Figure 1A:
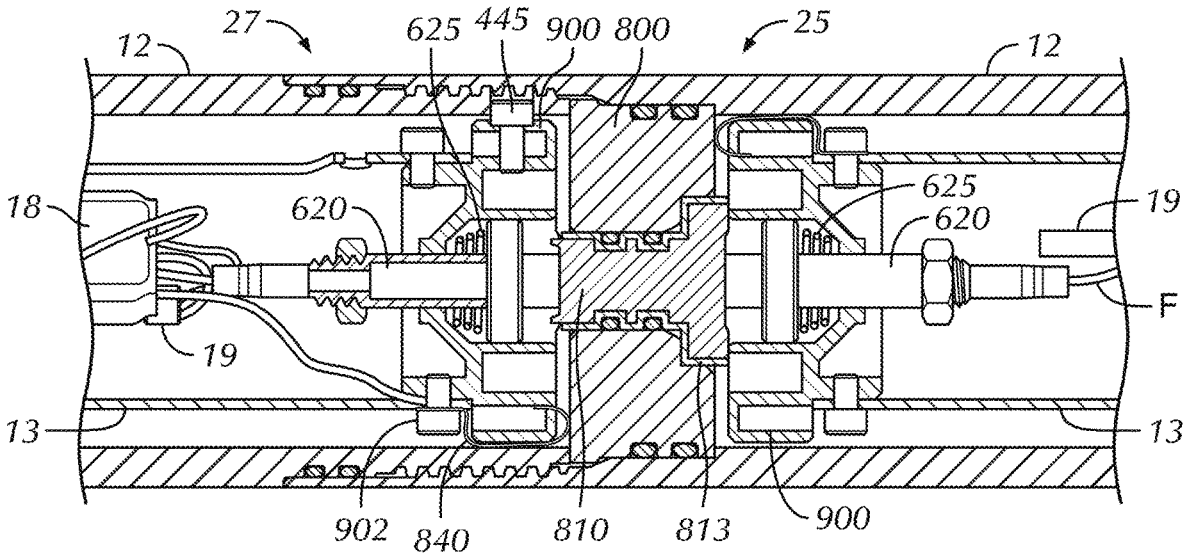
FIG. 1A shows a cross section of two mated perforating guns (perf guns) using identical end cap designs, electrically connected through a blast shield with a T-shaped pass through propagating firing signals across gun junctions in accordance with an exemplary embodiment of the innovation.

In previous teachings, the inventor discussed use of rotary shouldered threaded connections, typically referenced as "pin" and "box" joints, for the gun casing to connect guns directly together without requiring intermediate subs. A teaching also provided for use of durable end caps on at least one end of the charge carrier or gun casing to isolate the gun from explosive forces of prior firings. These were usually sealed with O-rings, or other means to prevent moisture leakage from a fired gun into an unfired gun.

Wiring was improved by use of centralized contact pins biased outward from a gun's charge carrier to established electrical contact with neighboring guns. These centralized contacts may be slightly rounded, or polished to allow them to freely rotate against contact points without turning to bind the wires, stress the connectors, or otherwise compromise the electrical connections between the adjacent guns.

By moving detonators and firing circuitry within each gun's charge carrier, there is less outside of the guns to potentially fail during connection and handling operations. The detonators and firing circuitry are made accessible by a wiring window (an opening or void) in the charge carrier's side.

A gun casing's pin and box ends are generally standardized by industry best practices. Modification of the gun casing's pin end by shortening provides a location and opportunity to secure a blast shield or blast divider between the end of the pin and the internal shoulder of the adjacent gun casing's standard box connection.

One skilled in the arts would appreciate that other modifications, such as deepening the box end or modifying the shoulders, are also options of providing seating and securing of the blast shield. However, shortening the pin is the preferred embodiment as it is generally an easier modification to perform.

Previous teachings used one end cap of the charge carrier as a component of the blast shield and had a fixed receiver pin wired through the blast shield to present an exposed contact plate from the end of the gun casing. A less substantial end plate with an outwardly spring biased contact pin located at the distal end of the adjoining gun's casing would mate to complete the electrical circuit through the drill string upon joining the guns together.

A further refinement separated the blast shield from the substantial end cap so the blast shield could be placed in the distal end resulting in protection of both ends of an unassembled gun. However, in additional to complicating the assembly, the O-rings around the circumference of each component required to seal them against flooding of unfired guns could cause the wrong parts to rotate during assembly placing stress on the wiring within one or more of the charge carriers.

The current innovation is to use a T-shaped insulated feed thru pin to propagate an electrical signal through a blast shield secured within a pin box connection between two adjacent guns each having spring biased movable contact pins interfacing with the feed thru pin. This arrangement allows the use of substantially identical end caps with substantially similar spring biased contact pins on each end of the charge carrier while providing moisture protection and blast damage protection between adjacent guns.

The T-shaped feed thru pin is electrically conductive, with a centralized contact plate presented to both sides of the blast shield, and electrically isolated from the blast shield which is in contact with the pin and box ends of the gun casings, which are grounded. In another embodiment, the blast shield may be electrically non-conductive material which serves to isolate an electrically conductive T-shaped feed thru pin.

In another embodiment the T-shaped insulated feed thru pin and the blast shield may be combined into a single divider. The divider being an electrically conductive blast shield electrically insolated by a circumference of insulating material from the gun casings but presenting centralized contact plates to both guns to propagate firing signals along the drill string.

Further simplification of the assembly can be achieved by using a single end cap design for either end of the charge carrier. The end cap would have an alignment screw opening on an optionally reinforced section of the outer edge centering rim for receiving a gun body casing alignment screw passing through the gun body casing alignment hole to align the radically oriented shape charges of the charge carrier with scallops in the outer wall of the gun casing.

DETAILED DESCRIPTION OF THE DRAWINGS

Figure 1B:
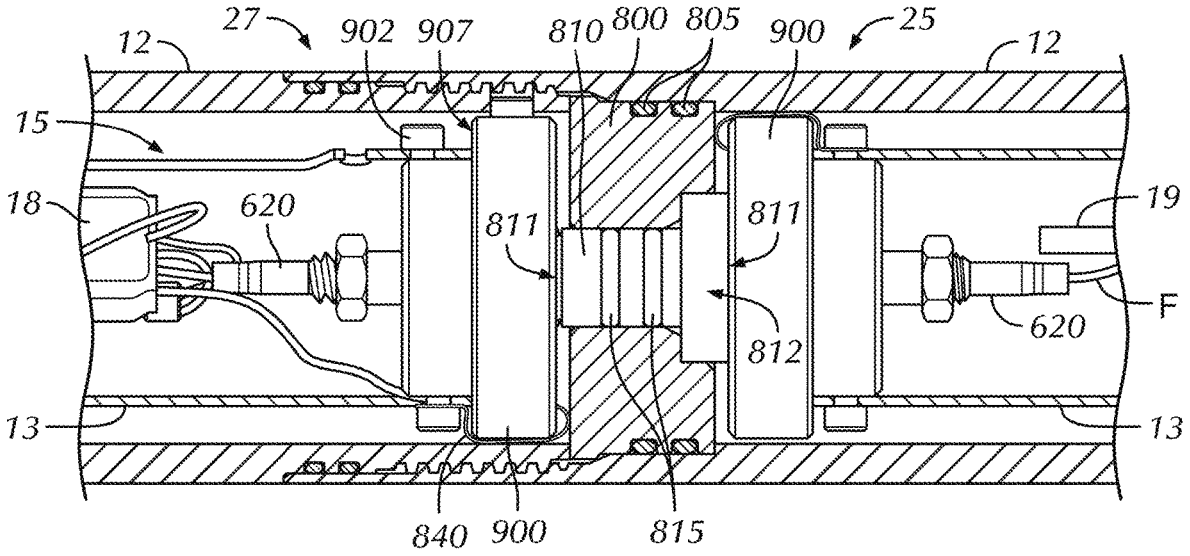
FIG. 1B shows a cut away view of two mated perf guns using identical end cap designs electrically connected through a blast shield with a T-shaped pass through propagating firing signals across gun junctions in accordance with an exemplary embodiment of the innovation.

FIG. 1A shows a cross section of two mated perforating guns (perf guns) using identical end cap designs, electrically connected through a blast shield with a T-shaped pass through propagating firing signals across gun junctions in accordance with an exemplary embodiment of the innovation. FIG. 1B shows a partial cross section of two mated perf guns using identical end caps and a blast shield with a T-shaped pass through propagating the firing signals across the junction in accordance with an exemplary embodiment of the innovation.

In these drawings, the gun casings (12) are joined by screwing together the pin (27) and box (25) ends of adjacent guns. Movable contact pins (620) biased outward by a biasing spring (625) from the end caps (900) at each end of the charge carriers (13) to propagate the firing line/firing signal (F) across joints between guns to all detonator circuits (18) for igniting detonator cords (19).

Guns are protected from blast force, flooding, and shrapnel from explosions in adjacent guns by a blast shield (800) sealed with O-rings (805) into the box end (25) by the modified pin end (27) of the adjacent gun. The blast shield (800) has a central passthrough opening with a signal conductor pin (810) sealed by O-rings (815).

One embodiment of the signal conductor pin (810) is T-shaped, with a large end (812) oriented toward the earlier firing of the two guns. The signal conductor pin (810) must be electrically insulated from the gun casing (12) which is grounded. This may be by the blast shield (800) which may be a durable, but electrically insulating material.

In another embodiment, the signal conductor pin's (810) conductive material is surrounded by an insulating layer (813) from the blast shield (800), with only the ends (811) being exposed to electrical contact with the movable contact pins (620) to propagate the firing signal (F). The end caps (900) are secured to charge carrier (13) by screws (902), at least one of which is connected to the grounding wire (G) of the detonation circuitry (18).

At least one of the screws (902) securing the end caps (900) to the charge carrier (13) also secures a grounding clip (840) which electrically connects the charge carrier (13) to the gun casing (12). This is necessary since the charge carrier (13) is centered and electrically isolated from the gun casing (12) by the end caps (900) at each end by the outer edge centering rim (907).

The charge carrier (13) can be removed from the gun casing (12) by pulling it out of the pin end (27) exposing the wiring window (15) which allows last minute access to the detonation circuitry (18) for connection, inspection, repair, testing, etc. The charge carrier (13) is then reinserted into the gun casing (12) and secured by an alignment screw (445) passing through an alignment hole in the pin end (27) of the gun casing (12), into an alignment hole in the outer edge centering rim (907) which ensures the radially oriented shape charges (not shown) align with scallops (not shown) in the gun casing (12).

Figure 2A:
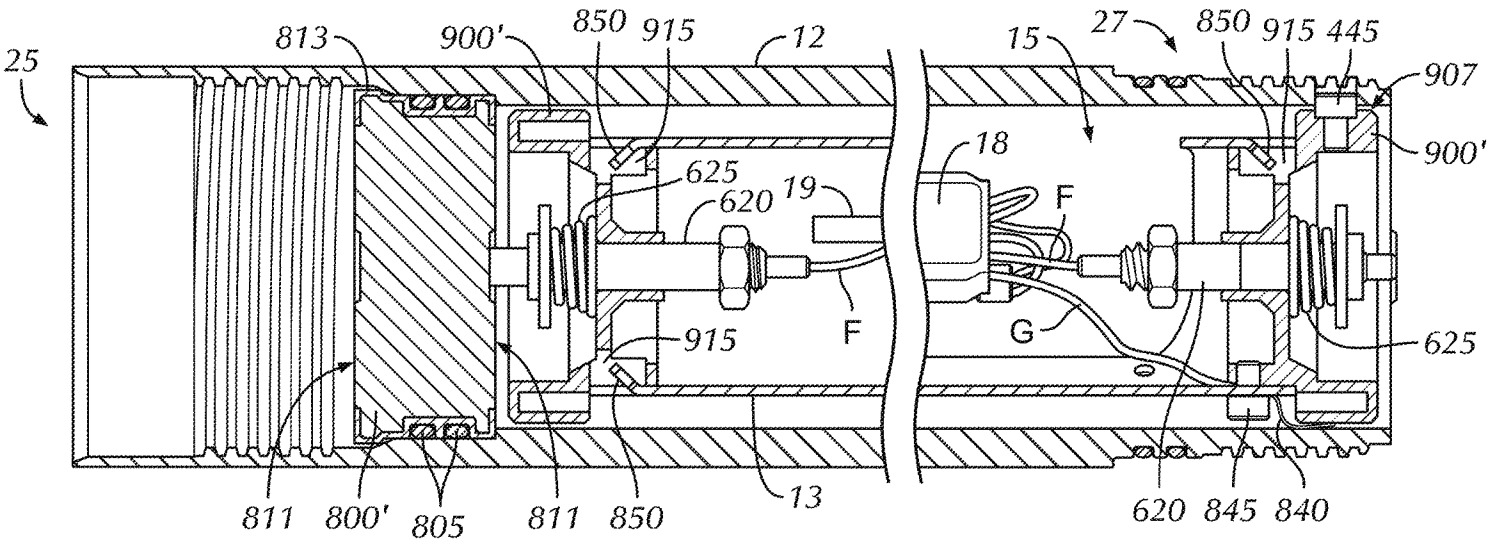
FIG. 2A shows a cross section of a perf guns using identical end cap designs for propagating a firing signals across gun junctions through an electrically conductive solid blast divider in accordance with an exemplary embodiment of the innovation.
Figure 2B:
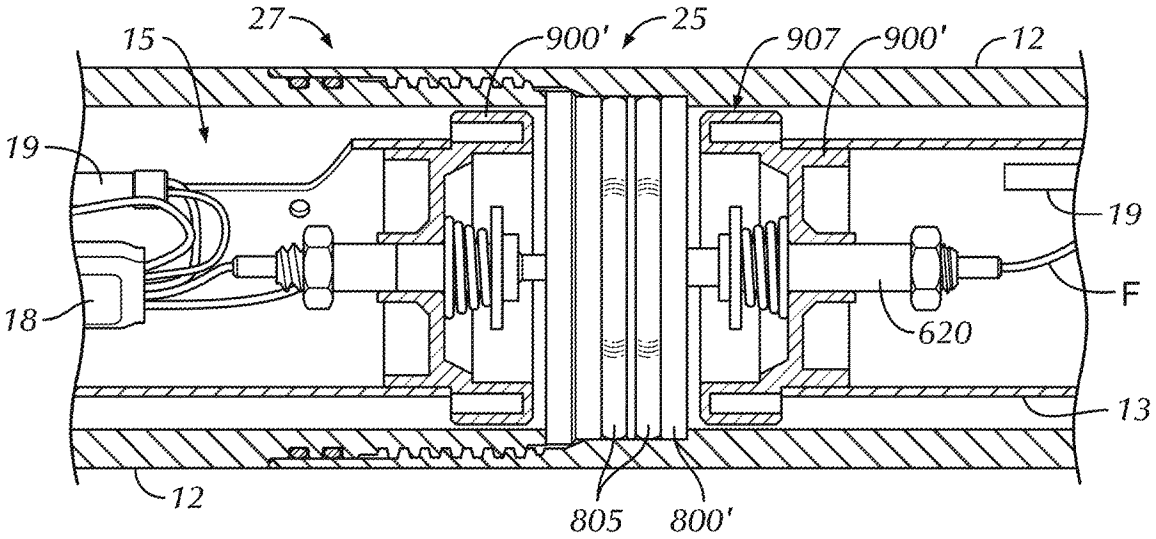
FIG. 2B shows a cross section of two mated perf guns using identical end cap designs propagating firing signals across the gun junction through an electrically conductive solid blast divider (not illustrated as a cross section) in accordance with an exemplary embodiment of the innovation.

FIG. 2A shows a cross section of a perf gun using identical end cap designs for propagating a firing signals across gun junctions through an electrically conductive solid blast divider in accordance with an exemplary embodiment of the innovation. FIG. 2B shows a cross section of two mated perf guns using identical end cap designs propagating firing signals across the gun junction through an electrically conductive solid blast divider (not illustrated as a cross section) in accordance with an exemplary embodiment of the innovation.

In these drawings, the gun's casings (12) are joined by screwing together the pin (27) and box (25) ends of adjacent guns. Movable contact pins (620) biased outward by a biasing spring (625) from the end caps (900') at each end of the charge carriers (13) to propagate the firing line/firing signal (F) across joints between guns to all detonator circuits (18) for igniting detonator cords (19).

Guns are protected from blast force, flooding, and shrapnel from explosions in adjacent guns by a blast divider (800') sealed with O-rings (805) into the box end (25) by the modified pin end (27) of the adjacent gun. The blast divider (800') is electrically conductive and has an insulating circumferential layer/coating (813), with only the ends (811) being exposed. The exposed ends (811) allow electrical contact with the movable contact pins (620) to propagate the firing signal (F) between adjacent guns.

The end caps (900') in this embodiment are secured to charge carrier (13) by tabs (850) bent inward to engage bendable tab openings (915); or optionally are secured to the charge carrier (13) by screws (902), as previously described. At least one point is secured by a grounding screw (845), connecting a grounding clip (840) extending outward to contact the gun casing (12), and electrically joining an internal grounding wire (G) of the detonation circuitry (18).

The charge carrier (13) can be removed from the gun casing (12) by pulling it out of the pin end (27) exposing the wiring window (15) which allows last minute access to the detonation circuitry (18) for connection, inspection, repair, testing, etc. The charge carrier (13) is then reinserted into the gun casing (12) and secured by an alignment screw (445) passing through an alignment hole in the pin end (27) of the gun casing (12), into an alignment hole in the outer edge centering rim (907) which ensures the radially oriented shape charges (not shown) align with scallops (not shown) in the gun casing (12).

Figure 3:
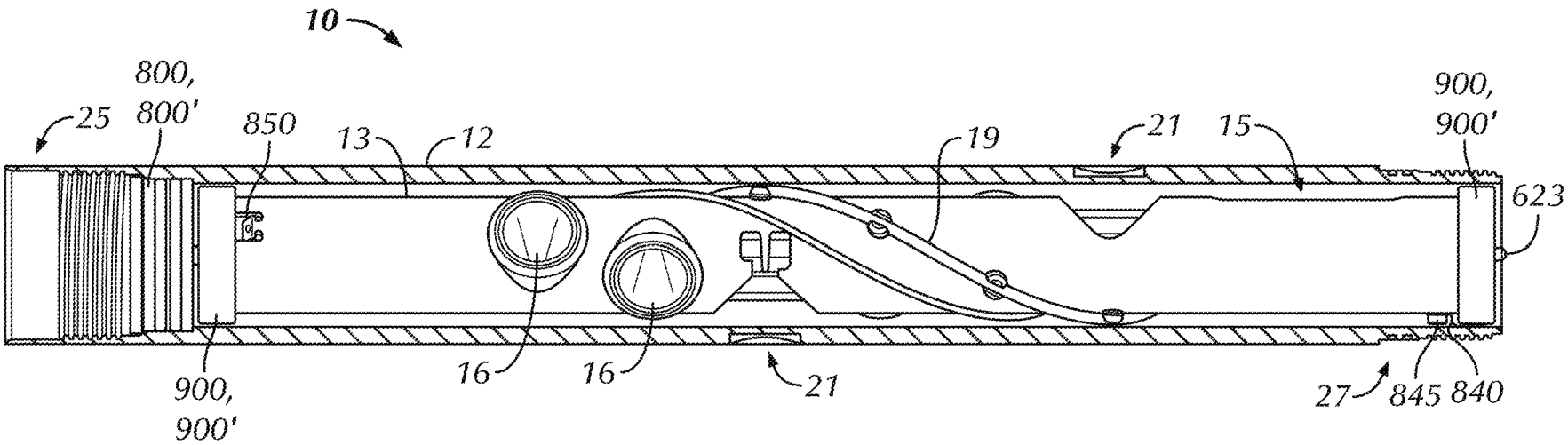
FIG. 3 illustrates a pin and box connectable perf gun with a cut-away gun casing having identical end caps and a blast shield in accordance with an exemplary embodiment of the innovation.

FIG. 3 illustrates a pin and box connectable perf gun with a cut-away gun casing having identical end caps and a blast shield in accordance with an exemplary embodiment of the innovation. This illustration of a perforating gun assembly (10) has a cut away of the gun casing (12) to show the charge carrier (13) with the end caps (900 or 900') secured at each end, and a blast shield (800) or blast divider (800') positioned in the box end (27) of the gun casing (12).

The end caps (900 or 900') are secured to the charge carrier (13) by bendable tabs (850) bent into tab openings (915, not labeled) or secured with screws (845), at least one of which secures a grounding clip (840) to contact the gun casing (12). This electrically grounds the charge carrier (13) and the internally located detonation circuitry (18, not visible) which is accessible through the wiring window (15).

the detonation circuitry (18, not visible) receives a firing signal passed through the contact head (623), commanding ignition of detonation cord (19) that explodes shape charges (16) outward through aligned scallops (21) in the outer surface of the gun casing (12).

Figure 4A:
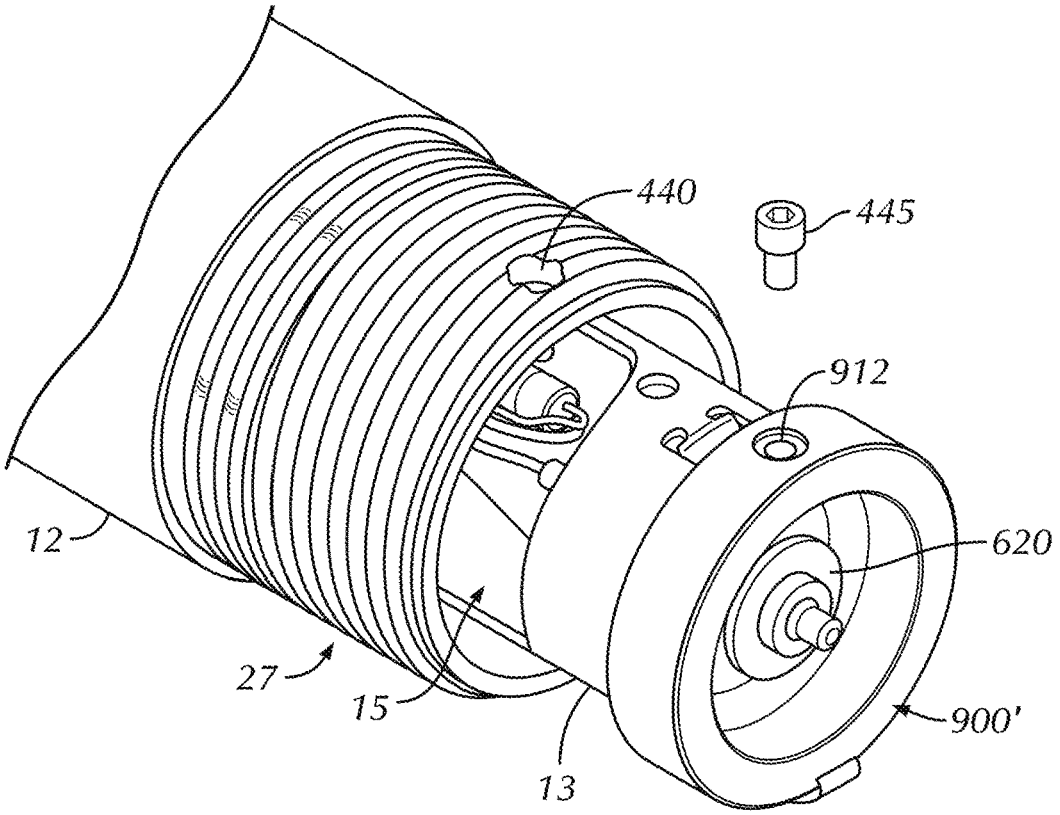
FIGS. 4A and 4B shows installation and alignment of a charge carrier into a gun casing from the pin end in accordance with an exemplary embodiment of the innovation.
Figure 4B:
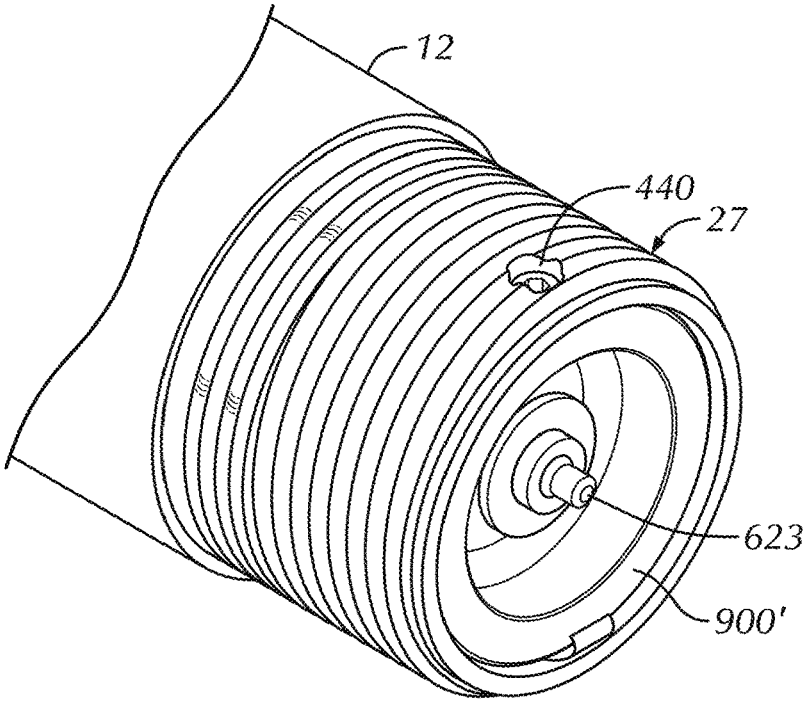

FIGS. 4A and 4B shows installation and alignment of a charge carrier into a gun casing from the pin end in accordance with an exemplary embodiment of the innovation. The charge carrier (13) may be removed from the gun casing (12)

through the pin end (27), to access the detonation circuitry (18, not labeled) through the wiring window (15).

Once the gun is wired for detonation, the end cap (900') of the charge carrier (13) is aligned and inserted into the pin end (27) of the gun casing (12) so the contact head (623) of the movable contact pin (625) in the end cap (900') extends from the gun. The alignment is secured by passing an alignment screw (445) through an alignment hole (440) in the pin end (27) of the gun casing (12) to mate with the alignment screw hole (912) of the end cap (900').

Figure 5:
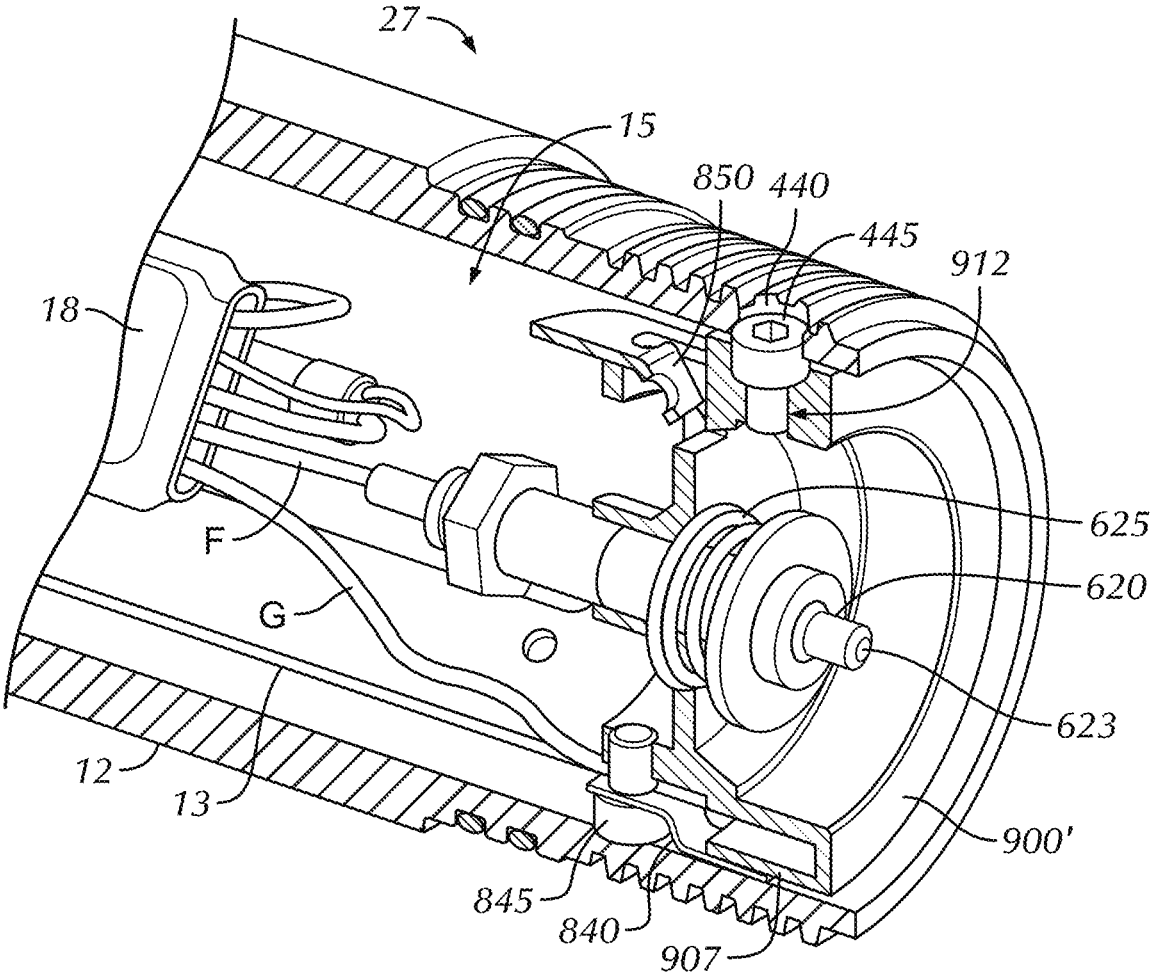
FIG. 5 shows a cross section of the pin end of a perf gun, the charge carrier having an end cap attached and aligned within the gun casing in accordance with an exemplary embodiment of the innovation.

FIG. 5 shows a cross section of the pin end of a perf gun, the charge carrier having an end cap attached and aligned within the gun casing in accordance with an exemplary embodiment of the innovation. The pin end (27) of the gun casing (12) and charge carrier (13) with its end cap 900') are cut away to show the internal detonation circuitry (18) accessible through a wiring window (15).

The ground (G) is connected electrically to the charge carrier (13) by a grounding screw (845) which secures a grounding clip (840) to the gun casing (12). The firing signal (F) is connected electrically to the movable contact pin (620) biased outward from the center of the end cap (900') by a biasing spring (625) so the contact head (623) extends beyond the end of the charge carrier (12).

The charge carrier (13) is positioned within the gun casing (12) by an alignment screw (445) extending through an alignment hole (440), into an alignment screw opening (912) on the outer edge centering rim (907) of the end cap (900'), secured by bendable tabs (850).

Figure 6:
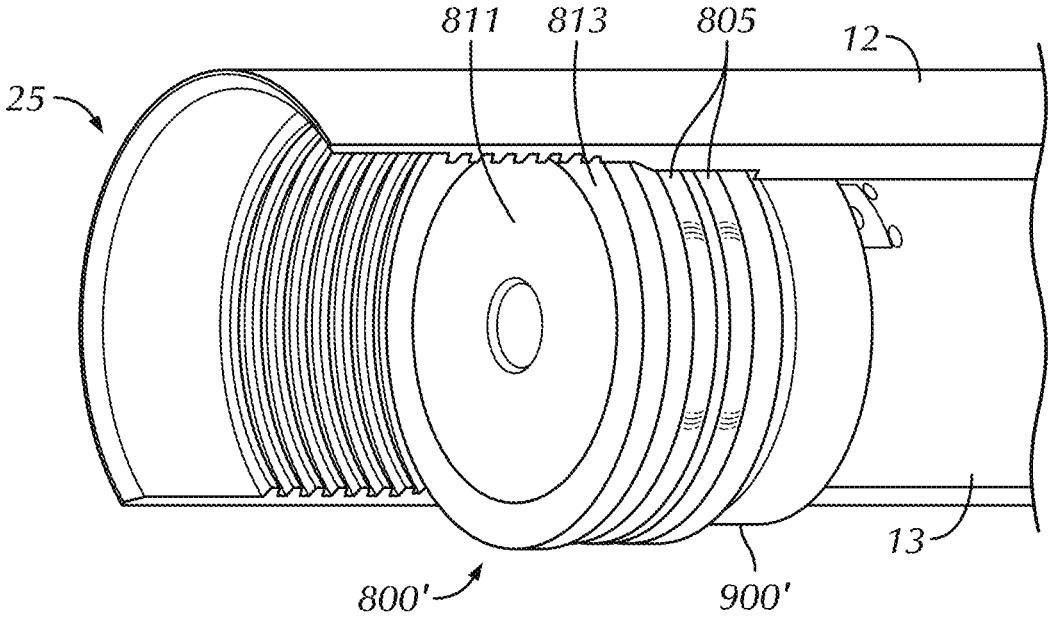
FIG. 6 shows a box end of a perf gun with a cut-away gun casing illustrating placement of a blast shield in accordance with an exemplary embodiment of the innovation.
Figure 7:
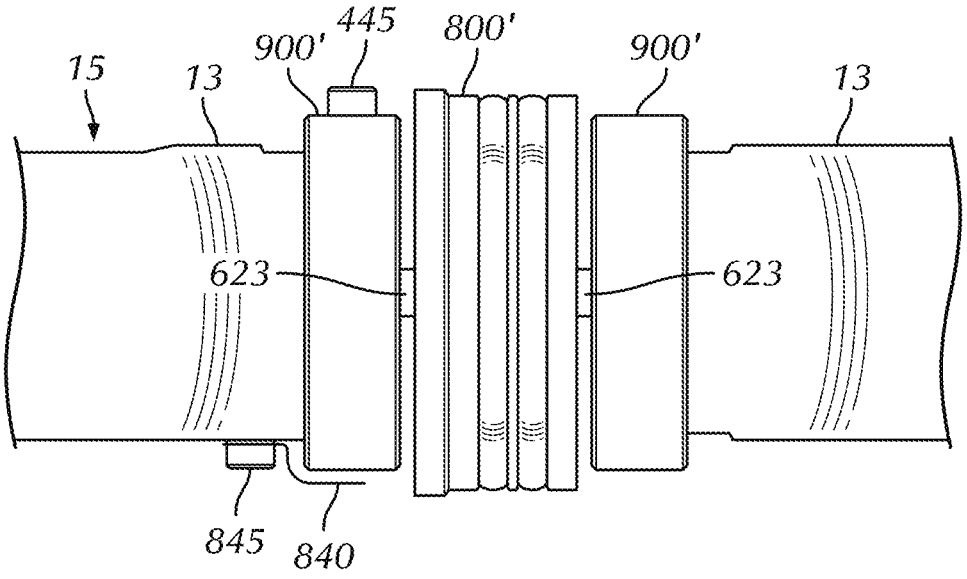
FIG. 7 illustrates a gun junction of two charge carriers, sans gun casing, having identical end caps and a blast shield in accordance with an exemplary embodiment of the innovation.

FIG. 6 shows a box end of a perf gun with a cut-away gun casing illustrating placement of a blast shield in accordance with an exemplary embodiment of the innovation. FIG. 7 illustrates a gun junction of two charge carriers, sans gun casing, having identical end caps and a blast shield in accordance with an exemplary embodiment of the innovation.

The box end (25) of the gun casing (12) in FIG. 6 is cut away to reveal the charge carrier (13) with a secured end cap (900') positioned against a conductive contact end (811) of the blast divider (800'). The gun casing (12) are omitted from FIG. 7 to show charge carriers (13) of adjacent guns.

The blast divider (800') has an electrically conductive center, insulated (813) around the circumference, having O-rings (805) to seal against the shoulder of the gun casing's (12) box end (25) and being secured by the pin end of the adjacent gun's pin end, which allows the contact heads (623) extending from each end cap (900') to propagate the firing signal.

Figure 8A:
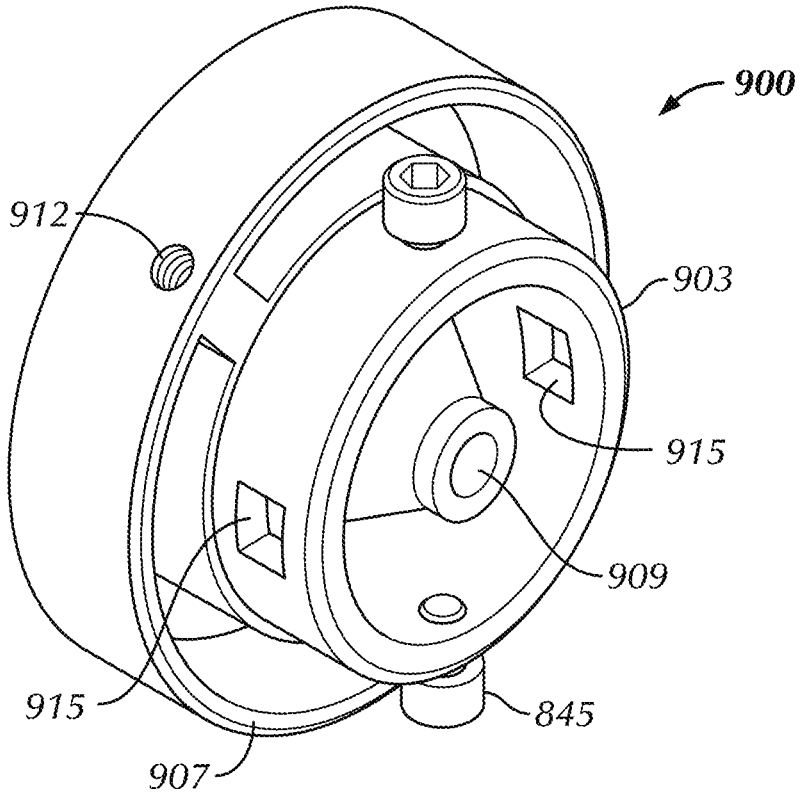
FIGS. 8A and 8B show a perspective view and a front (charge carrier side) view of an embodiment of an end cap for use at either end of a charge carrier for a perf gun in accordance with an exemplary embodiment of the innovation.
Figure 8B:
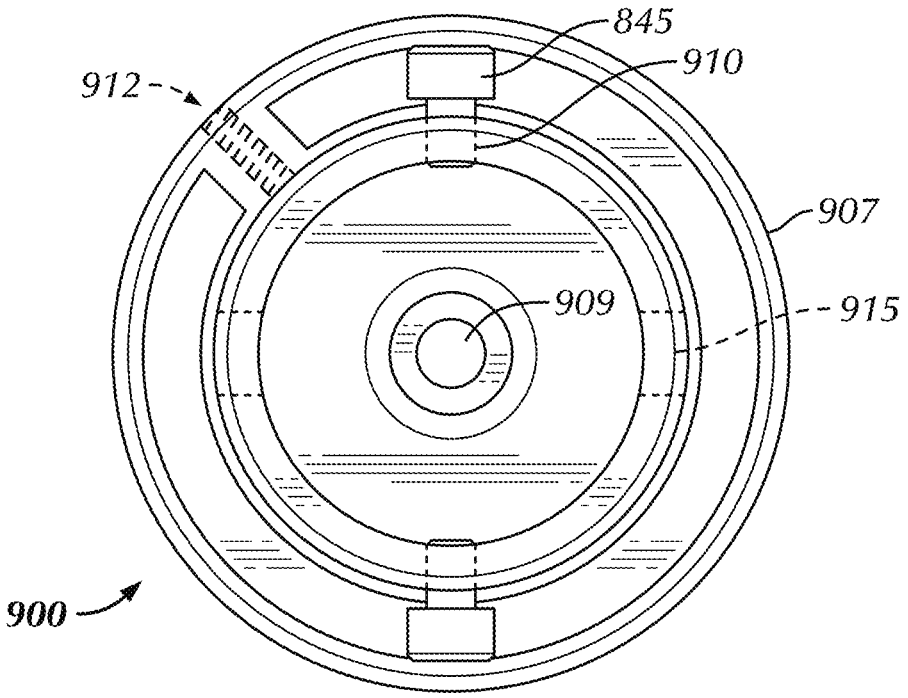

FIGS. 8A and 8B shows a perspective view and a front (charge carrier side) view of an embodiment of an end cap for use at either end of a charge carrier for a perf gun in accordance with an exemplary embodiment of the innovation. The end cap (900) mates with the charge carrier (13, not shown) on the front side (903) (charge carrier side) secured by screws (845) through the charge carrier into a screw hole (910), or alternatively by bendable tabs (850, not shown) on the charge carrier which are bent into tab openings (915) on the end cap (900).

The outer edge centering rim (907) of the end cap (900) angles outward to press against the inner surface of the gun casing (12, not shown) to keep the charge carrier centered. One point is reinforced and drilled to provide an alignment screw opening (912), which is oriented to align shape charges of the charge carrier with scallops in the outer surface of the gun casing. A movable contact pin connected to a fire signal wire is secured by a nut in the contact pin opening (909) in the center of the end cap (900) against the force of a biasing spring on the distal side urging the contact head of the pin away from the charge carrier.

Figure 9A:
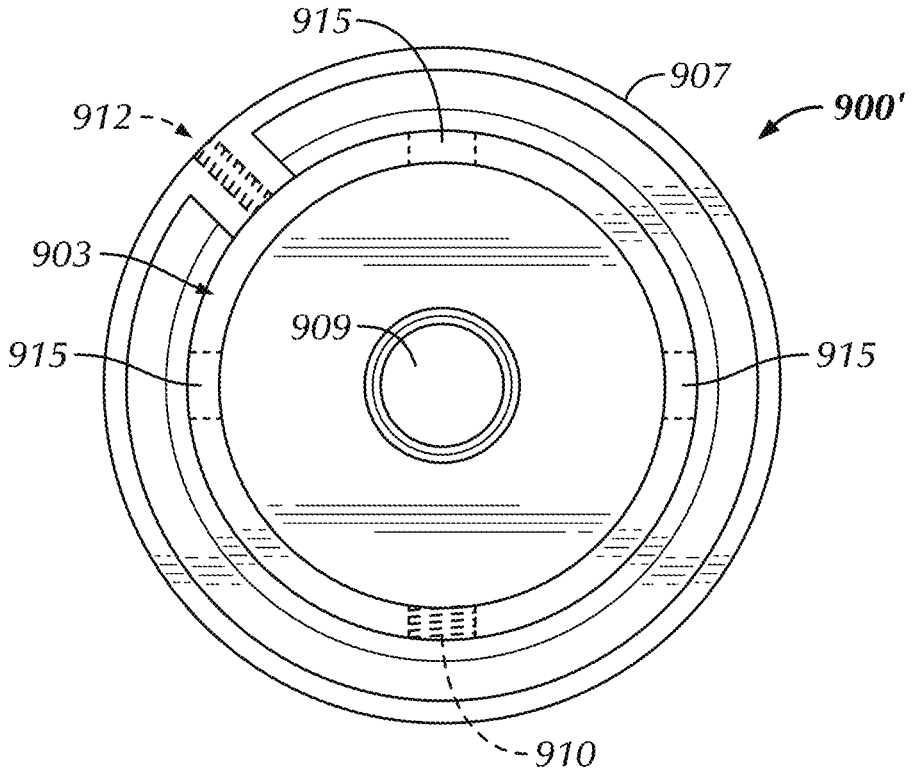
FIGS. 9A and 9B show a front (charge carrier side) view and a side view cross section of an embodiment of an end cap for use at either end of a charge carrier for a perf gun in accordance with an exemplary embodiment of the innovation.
Figure 9B:
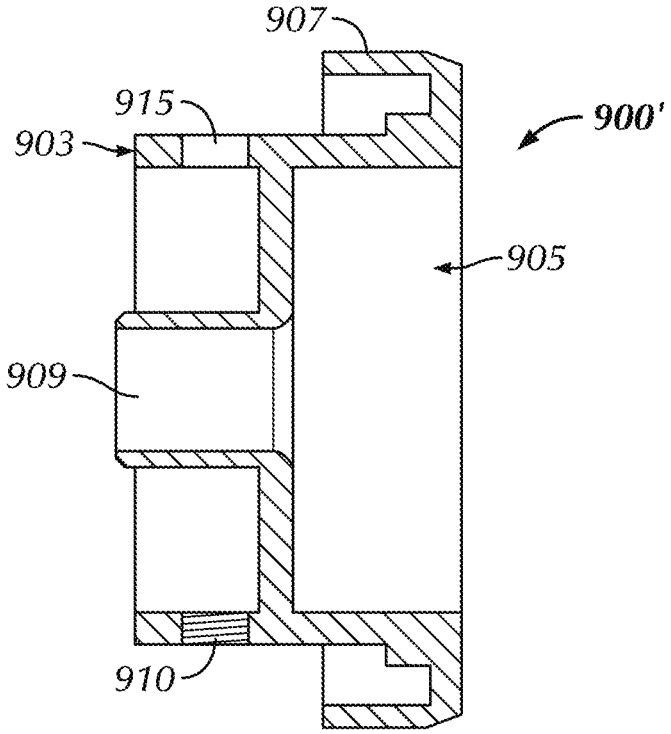

FIGS. 9A and 9B show a front (charge carrier side) view and a side view cross section of an embodiment of an end cap for use at either end of a charge carrier for a perf gun in accordance with an exemplary embodiment of the innovation. The end cap (900') mates with the charge carrier (13, not shown) by a rim on the front side (903) (charge carrier side) secured by bendable tabs (850, not shown) on the charge carrier which are bent into tab openings (915) on the end cap (900'). In at least one position, the bendable tab is replaced by a grounding screw (845) electrically connecting a grounding wire inside the charge carrier to a grounding clip outside the charge carrier that contacts the gun casing.

The outer edge centering rim (907) of the end cap (900) angles outward to press against the inner surface of the gun casing (12, not shown) to keep the charge carrier centered. One point is reinforced and drilled to provide an alignment screw opening (912), which is oriented to align shape charges of the charge carrier with scallops in the outer surface of the gun casing. A movable contact pin connected to a fire signal wire is secured by a nut in the contact pin opening (909) in the center of the end cap (900) against the force of a biasing spring on the distal side urging the contact head of the pin away from the charge carrier.

Figure 10:
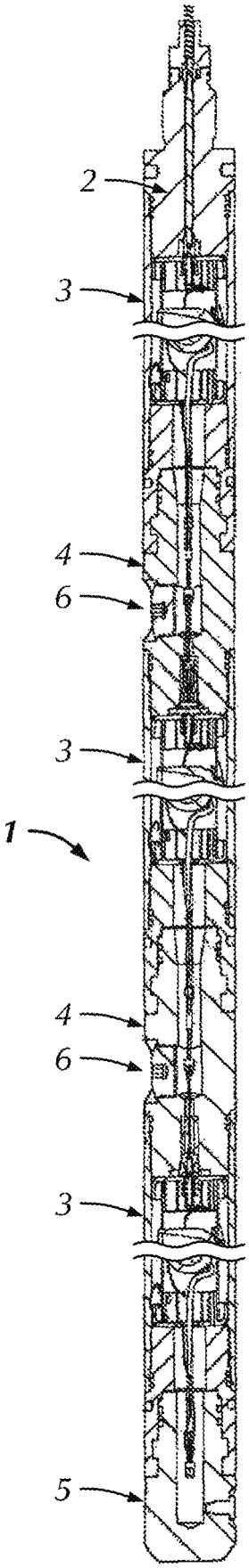
FIG. 10 (Prior Art)
FIG. 10 is a cross-section of an assembly of multiple armed and assembled guns in a manner that is utilized in the industry.

FIG. 10 is a cross-section of an assembly of multiple armed and assembled guns in a manner that is utilized in the industry. The perf assembly (1) has a firing head (2), a plurality of perforating guns (3), each containing a charge carrier, two tandem subs (4), and a bottom sub (5). In such a configuration, the tandem subs (4) may contain access ports (6) for accessing internal wiring during assembly.

Figure 11:
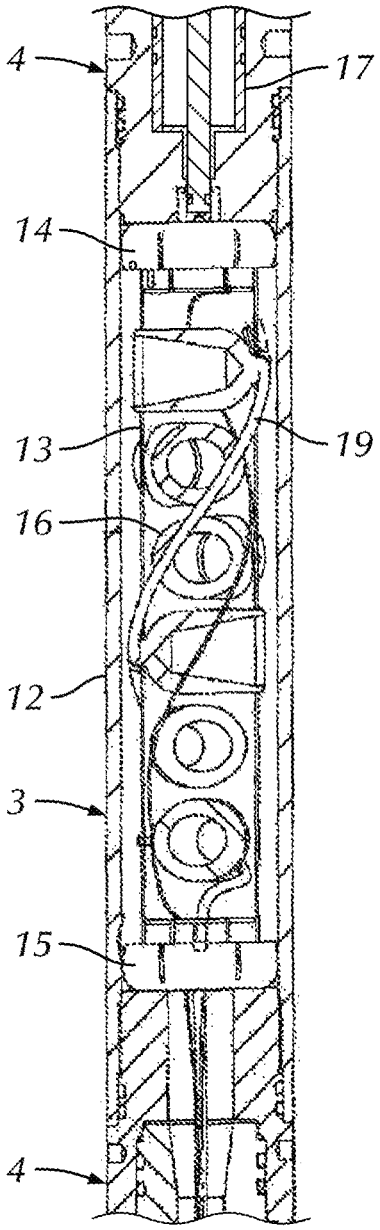
FIG. 11 (Prior Art)
FIG. 11 shows a cross section of a single gun joined on each end to an adjacent gun.

FIG. 11 shows a cross section of a single gun joined on each end to an adjacent gun. In the example shown, a tandem sub assembly is associate with each gun, as is standard in the industry. The gun (3) comprises a charge carrier (13) with a plurality of explosive shape charges (16) joined by a detonation cord or fuse (19). The charge carrier (13) is supported, substantially centered, within the gun body casing (12) by an insulating top end (14) and an isolating bottom end (15). The top and bottom ends of the charge carrier may be one of several configurations, some of which are described in the applicant's other innovation descriptions incorporated above. The specifics of the top and bottom ends are not significant to the innovation described in this specific application.

One can see in the interior of the carrier (13) that the shaped charges (16) are shown set in radial fashion perpendicular to the gun wall, to the carrier, and, when the guns are within the well, to the well casing. In the illustration, six shape charges are illustrated, but the actual number and orientation will vary.

The shaped charges are explosives set in such a manner that they concentrate the force of the explosion outward, generating a jet of gas (plasma) at high pressure and temperature, that pulls the metal from the interior of the charge and projects it outward until it arrives at the well formation; with this action, the charges produce a perforating effect that is variable in proportion to the potency of the charges. It is well known practice to scallop the gun body casing to reduce the force necessary to pierce the casing at the desired location, and so that burrs formed from the perforation do not damage the walls of the well during later extraction of the gun after firing.

In each intermediate joint or intermediate sub or tandem sub (4) one can see the pressure activated changeover switch (17) referred to as the pressure switch, from which wires extend to the rest of the assembly. When the detonator is activated, a detonation is propagated by way of a "fuse"—or detonating cord (19)—to each of the shaped charges in the carrier (13) that burst in simultaneous fashion within the corresponding gun (3).

Figure 12:
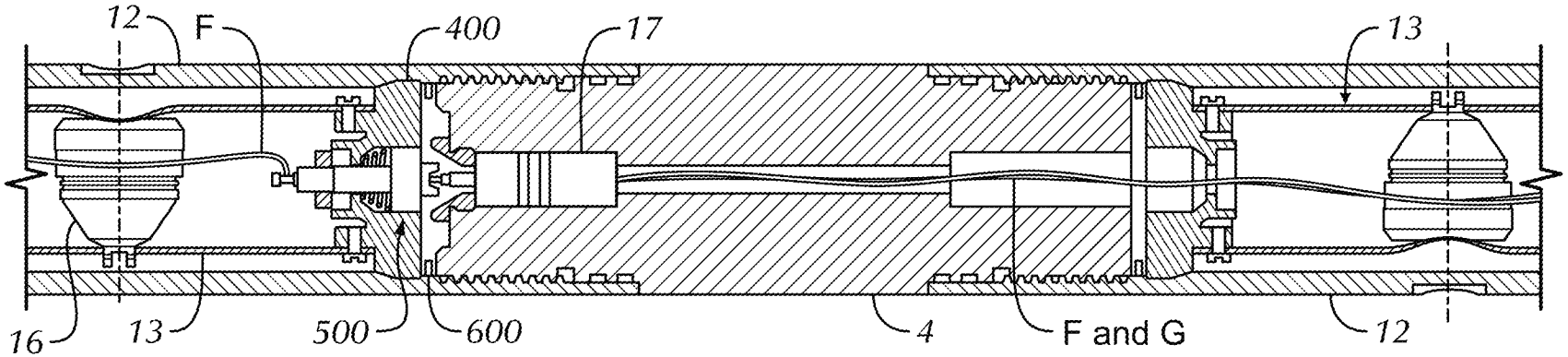
FIG. 12 (Prior Art)
FIG. 12 shows a cross section of an intermediate sub containing a pressure switch joining two adjacent guns with pass through wiring.

FIG. 12 shows a cross section of an intermediate sub containing a pressure switch joining two adjacent guns with pass through wiring. The gun body casing (12) of each gun has a box end with the charge carrier (13) terminated by an end cap (400) and secured in the gun body casing (12) by a snap ring (600). The intermediate sub (4) has two pin ends, a pass-through opening for wiring, and the option of inserting a pressure switch (12) at either end to ensure it is close to the anticipated blast direction. In the left side gun, a spring-loaded connector pin (500) contacts the electrical contact of the pressure switch (17), which is held in the tandem sub (4) which was previously wired (F and G) to the adjoining gun.

The diagrams in accordance with exemplary embodiments of the innovation are provided as examples and should not be construed to limit other embodiments within the scope of the invention. For instance, heights, widths, and thicknesses may not be to scale and should not be construed to limit the invention to the particular proportions illustrated. Additionally, some elements illustrated in the singularity may actually be implemented in a plurality. Some element illustrated in the plurality could actually vary in count. Some elements illustrated in one form could actually vary in detail. Such specific information is not provided to limit the invention.

The above discussion is meant to be illustrative of the principles and various embodiments of the present innovation. Numerous variations and modifications will become apparent to those skilled in the art once the above disclosure is fully appreciated. It is intended that the following claims be interpreted to embrace all such variations and modifications.

What is claimed is:

1. A drill string for perforating wells comprising:

a gun assembly comprising:

a gun body casing, the casing being a hollow cylinder, with an internally threaded female connection, a box connection at one end and a mating externally threaded male connection, a pin connection as the distal end;

a charge carrier, the carrier being a hollow cylinder, with exterior diameter less than the interior diameter of the casing, and with a length shorter than the casing;

a plurality of shape charges within the carrier, the charges oriented outward toward the interior surface of the casing, and inter connected by a detonator cord;

end caps affixed to the ends of the carrier, co-axially aligning the carrier with the casing;

a modified pin connection on the casing, wherein the pin end is shorter than the depth of the box connection;

a blast shield comprising: a cylindrical disk of durable material with at least one O-ring around the outer diameter fitting within and sealing against the interior surface of the box connection, secured by the modified pin end of the mated adjacent gun assembly;

a centrally aligned pass-thru conducting an electrical signal between contact pins projecting outward through the end caps of adjacent gun assemblies;

a grounding clip electrically connecting the casing to detonation circuitry within the carrier; and at least one electrically conductive contact pin centrally oriented and extending through an end cap to propagate an electrical signal to the detonation circuitry.

2. The drill string of claim 1 wherein the electrically conductive contact pin is biased outward from the carrier by a spring.

3. The drill string of claim 2 wherein a plurality of gun assemblies is mated end to end within the drill string by joining the box end of a first gun assembly to the pin end of an adjacent second gun assembly.

4. The drill string of claim 1 wherein the blast shield's durable material is electrically insulating and the pass-thru is an electrically conductive.

5. The drill string of claim 4 wherein the pass-thru and the opening within the blast shield have two external diameters with the larger oriented toward the gun assembly intended to detonate first.

6. The drill string of claim 1 wherein the blast shield's durable material is substantially comprised of the electrically conductive pass-thru, surrounded around the circumference by an electrically insulating material.

7. The drill string of claim 1 wherein the carrier further comprises a wiring window oriented to access a location for detonation circuitry to be placed and wired within the carrier prior to use.

8. The drill string of claim 1 further comprising:

a plurality of scallops on the external surface of the casing, aligned with outward oriented shape charges within the carrier, wherein the carrier is aligned with the casing by an alignment pin passing through threads of the pin end and securing to a carrier end cap.

9. The drill string of claim 8 wherein the alignment pin is a screw.

10. A perforation gun comprising:

a body casing, the casing being a hollow cylinder, with an internally threaded female connection, a box connection at one end and a mating externally threaded male connection, a pin connection as the distal end;

a charge carrier, the carrier being a hollow cylinder, with exterior diameter less than the interior diameter of the casing, and with a length shorter than the casing;

a plurality of shape charges within the carrier, the charges oriented outward toward the interior surface of the casing, and inter connected by a detonator cord;

end caps affixed to the ends of the carrier, co-axially aligning the carrier with the casing;

a modified pin connection on the casing, wherein the pin end is shorter than the depth of the box connection;

a blast shield comprising:

a cylindrical disk of durable material with at least one O-ring around the outer diameter fitting within and sealing against the interior surface of the box connection, secured by the modified pin end of the mated adjacent gun assembly, and a centrally aligned pass-thru conducting an electrical signal between contact pins projecting outward through the end caps of adjacent gun assemblies; and a grounding clip electrically connecting the casing to detonation circuitry within the carrier; and at least one electrically conductive contact pin centrally oriented and extending through an end cap to propagate an electrical signal to the detonation circuitry.

11. The perforation gun of claim 10 wherein the electrically conductive contact pin is biased outward from the carrier by a spring.

12. The perforation gun of claim 11 wherein the gun mates end to end with an adjacent second gun.

13. The perforation gun of claim 10 wherein the blast shield's durable material is electrically insulating and the pass-thru is an electrically conductive.

14. The perforation gun of claim 13 wherein the pass-thru and the opening within the blast shield have two external diameters with the larger oriented toward the box end of the gun.

15. The perforation gun of claim 13 wherein the pass-thru and the opening within the blast shield has two external diameters with the larger oriented toward the pin end of the gun.

16. The perforation gun of claim 10 wherein the blast shield's durable material is substantially comprised of the electrically conductive pass-thru, surrounded around the circumference by an electrically insulating material.

17. The perforation gun of claim 10 wherein the carrier further comprises a wiring window oriented to access a location for detonation circuitry to be placed and wired within the carrier prior to use.

18. The perforation gun of claim 10 further comprising:

a plurality of scallops on the external surface of the casing, aligned with outward oriented shape charges within the carrier, wherein the carrier is aligned with the casing by an alignment pin passing through the threads of the pin end and securing to a carrier end cap.

19. The perforating gun of claim 18 wherein the alignment pin is a screw.

* * * * *